United States Patent [19]

Baylor

[11] Patent Number: 4,468,667

[45] Date of Patent: Aug. 28, 1984

[54] DETECTION OF AN IDENTIFICATION SIGNAL CONTAINED WITHIN A COMPOSITE SIGNAL, WITHOUT FALSE SIGNAL RECOGNITION

[75] Inventor: John T. Baylor, San Diego, Calif.

[73] Assignee: Cubic Corporation, San Diego, Calif.

[21] Appl. No.: 298,877

[22] Filed: Sep. 2, 1981

[51] Int. Cl.[3] ..... H04K 1/06; H04L 9/00

[52] U.S. Cl. ..... 343/379; 455/30; 178/22.08; 375/2.1

[58] Field of Search ..... 375/2.1; 340/825.34; 455/26, 30; 178/22.08; 343/6.5 LC, 379; 371/68, 69

[56] References Cited

U.S. PATENT DOCUMENTS 4,266,226 5/1981 McNaul et al. ..... 343/379

4,379,206 4/1983 Aoki ..... 371/68

*Primary Examiner*—Theodore M. Blum

*Attorney, Agent, or Firm*—Brown & Martin

[57] ABSTRACT

A system for detecting the presence in a sampled composite signal of an identification signal having a predetermined frequency without falsely recognizing other sharp signal transitions in the sampled signal as the identification signal. The system includes a delay line for delaying the composite signal by one-half the cycle of the identification signal as defined by the predetermined frequency to thereby provide a delayed signal; a bias network for biasing the composite signal to provide a first biased signal that is biased a predetermined differential above the composite signal, and to provide a second biased signal that is biased the predetermined differential below the composite signal; a first comparator for comparing the first biased signal to the delayed signal to provide a first comparison signal that indicates when the delayed signal is above the first biased signal; a second comparator for comparing the second biased signal to the delayed signal to provide a second comparison signal that indicates when the delayed signal is below the second biased signal; and a signal processor for processing the first and second comparison signals to provide a flag signal that indicates when the delayed composite signals both periodically rises above the first biased signal at the predetermined frequency and periodically falls below the second based signal at the predetermined frequency, to thereby indicate detection of the identification signal.

3 Claims, 3 Drawing Figures

| | | | | | | |
|---|---|---|---|---|---|---|
| LINE 46 | 1 | 0 | 1 | 0 | 1 | 0 |
| LINE 48 | 0 | 1 | 0 | 1 | 0 | 1 |
| LINE 50 | 1 | 1 | 1 | 1 | 1 | 1 |
| LINE 52 | 1 | 1 | 1 | 1 | 1 | 1 |
| LINE 54 | 1 | 1 | 1 | 1 | 1 | 1 |

| | | | | | | | | | | |
|---|---|---|---|---|---|---|---|---|---|---|
| LINE 46 | 0 | 0 | 0 | 0 | 0 | 0 | 0 | 0 | 0 | 0 |
| LINE 48 | 0 | 0 | 0 | 1 | 1 | 0 | 0 | 0 | 0 | 0 |
| LINE 50 | 0 | 0 | 0 | 0 | 0 | 0 | 0 | 0 | 0 | 0 |
| LINE 52 | 0 | 0 | 0 | 1 | 0 | 1 | 0 | 0 | 0 | 0 |
| LINE 54 | 0 | 0 | 0 | 0 | 0 | 0 | 0 | 0 | 0 | 0 |

DETECTION OF AN IDENTIFICATION SIGNAL CONTAINED WITHIN A COMPOSITE SIGNAL, WITHOUT FALSE SIGNAL RECOGNITION

BACKGROUND OF THE INVENTION

The present invention generally pertains to detection of the presence of an identification signal within a composite signal, and is particularly directed to avoiding falsely recognizing as identification signals, other sharp transitions in the composite signal.

The present invention is useful for detecting sidelobe identification signals in a system in which sidelobe signals are modulated by an identification signal so that the sidelobe signals can be discriminated from the main beam signals by detection of the identification signal. A prior art system utilizing a sidelobe identification signal for sidelobe descrimination is described in the U.S. Pat. No. 4,266,226 to McNaul et al.

In one prior art system, the presence of an identification signal in a sampled composite signal is detected by delaying the composite signal by one-half the frequency of the identification signal and comparing the delayed composite signal with the undelayed composite signal. The composite signal is delayed in this prior art system by a sample-and-hold circuit. This prior art system uses a simple window detector to detect the presence of the identification signal by determining whether a change in voltage has occurred. However, this prior art system is sensitive to all sharp signal transitions that occur within the half-cycle period of the identification signal, and thereby falsely recognizes as identification signals other sharp transitions in the signal being sampled. As a result, a sharp transition is a main beam signal could be falsely recognized as a sidelobe identification signal.

SUMMARY OF THE INVENTION

The present invention is an improved system for detecting the presence in a sampled composite signal of an identification signal having a predetermined frequency without falsely recognizing other sharp signal transitions in the sampled signal as the identification signal. The system of the present invention includes a delay line for delaying the composite signal by one-half the cycle of the identification signal as defined by the predetermined frequency to thereby provide a delayed signal; a bias network for biasing the composite signal to provide a first biased signal that is biased a predetermined differential above the composite signal, and to provide a second biased signal that is biased the predetermined differential below the composite signal; a first comparator for comparing the first biased signal to the delayed signal to provide a first comparison signal that indicates when the delayed signal is above the first biased signal; a second comparator for comparing the second biased signal to the delayed signal to provide a second comparison signal that indicates when the delayed signal is below the second biased signal; and a signal processor for processing the first and second comparison signals to provide a flag signal that indicates when the delayed composite signal both periodically rises above the first biased signal at the predetermined frequency and periodically falls below the second biased signal at the predetermined frequency, to thereby indicate detection of the identification signal.

The theory of operation of the system is discussed in relation to the description of the preferred embodiment, as are additional features of the present invention.

DESCRIPTION OF THE PREFERRED EMBODIMENT

Figure 1:
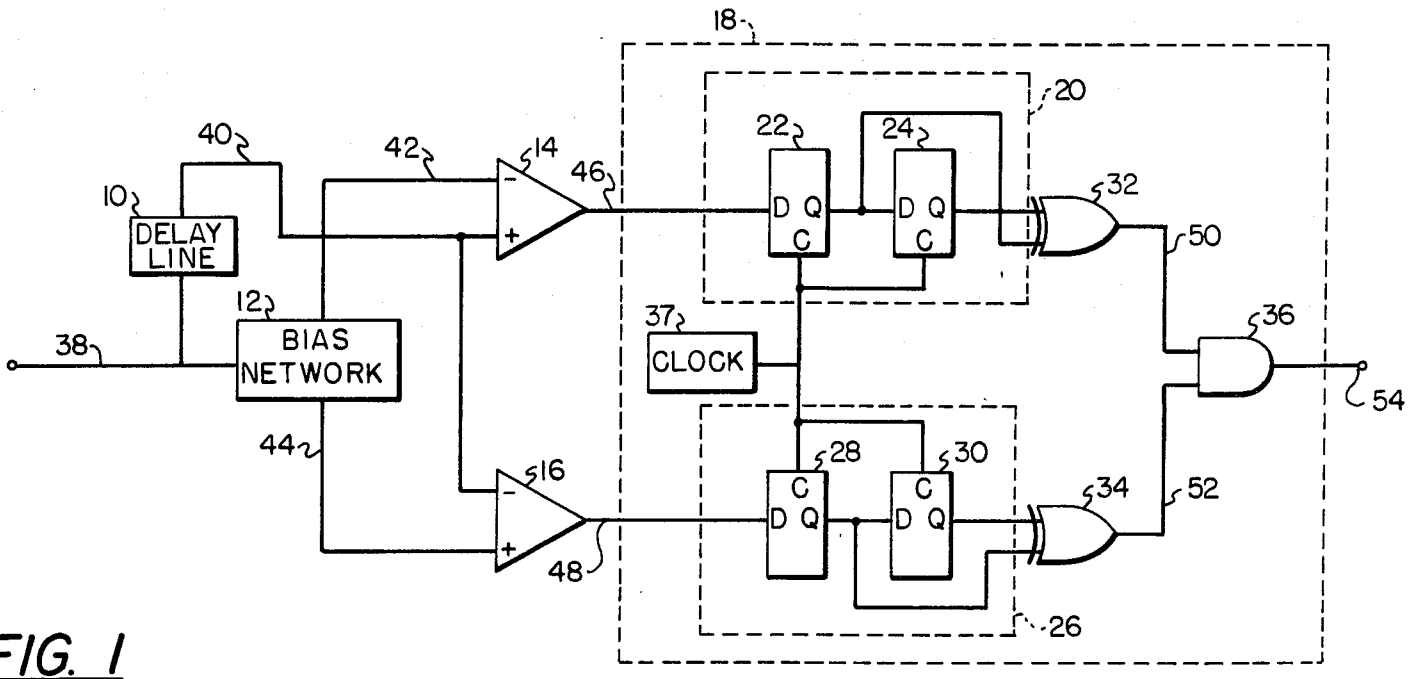
FIG. 1 is a schematic diagram of the system of the present invention.

Referring to FIG. 1, the system of the present invention includes a delay line 10, a bias network 12, a first comparator 14, a second comparator 16 and a signal processor 18. The signal processor 18 includes a first two-stage-shift register 20 consistng of flip-flops 22 and 24, a second two-stage shift register 26 consisting of flip-flops 28 and 30, a first exclusive OR gate 32, a second exclusive OR gate 34, an AND gate 36 and a clock 37.

A sampled composite signal on line 38 is provided to the delay line 10 and the bias network 12. It is desired to determine whether the sample composite signal on line 38 contains an identification signal having a predetermined frequency.

The delay line 10 preferably is an analog delay line such as may be provided by a cable or a passive L-C circuit. An analog delay line is more reliable and less expensive than a sample-and-hold circuit.

The delay line 10 delays the composite signal on line 38 by one-half the cycle of the identification signal as defined by the predetermined frequency to thereby provide a delayed signal on line 40.

The bias network biases the composite signal on line 38 to provide a first biased signal on line 42 that is biased a predetermined differential above the composite signal on line 38, and to provide a second biased signal on line 44 that is biased a predetermined differential below the composite signal on line 38.

The predetermined differential must be less than the amplitude of the sampled composite signal on line 38 and may be adjusted as necessary in relation to the amplitude of sample composite signal. Alternatively, the amplitude of sample composite signal provided onto line 38 may be adjusted to be greater than the predetermined differential.

The comparator 14 compares the first biased signal on line 42 to the delayed signal on line 40 to provide a first comparison signal on line 46 that indicates when the delayed signal on line 40 is above the first biased signal on line 42. The first comparator 14 is adapted for providing as the first comparison signal on line 46 a binary signal that changes state in accordance with whether the delayed signal on line 40 is above the first biased signal on line 42.

Figure 2:
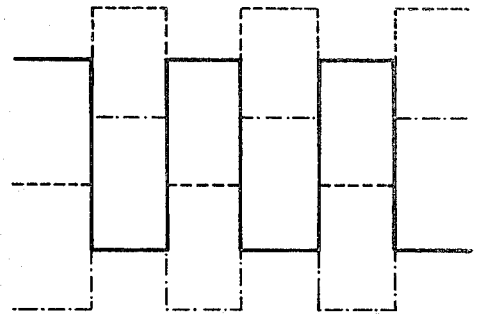
FIG. 2 illustrates signal conditions within the system when an identification signal is detected.

Referring to FIG. 2, it is seen that the binary comparison signal on line 46 is a binary "1" when the delayed signal on line 40 is above the first biased signal on line 42, and a binary "0" when the delayed signal on line 40 is below the first biased signal on line 42.

The second comparator 16 compares the second biased signal on line 44 to the delayed signal on line 40 to provide a second comparison signal on line 48 that indicates when the delayed signal on line 40 is below the second biased signal on line 44.

The second comparator 16 is adapted for providing as the second comparison signal on line 48 a binary signal that changes state in accordance with whether the delayed signal on line 40 is below the second biased signal on line 44.

Referring again to FIG. 2, it is seen that the binary comparison signal on line 46 is a binary "1" when the delayed signal on line 40 is below the second biased signal on line 44, and a binary "0" when the delayed signal on line 40 is above the second biased signal on line 44.

The signal processor 18 processes the first and second comparison signals on line 46 and 48 to provide a flag signal on line 54 that indicates when the delayed composite signal on line 40 both periodically rises above the first biased signal on line 42 at athe predetermined frequency and periodically falls below the second biased signal at the predetermined frequency and thereby indicates detection of the identification signal within the sampled composite signal.

Within the signal processor 18, the clock 37 is connected to the first two-stage shift register 20 for shifting the first comparison signal on line 6 through its first and second stages 22, 24 at twice the predetermined frequency. The clock 37 also is connected to the second two-stage shift register 26 for shifting the second comparison signal on line 46 through its first and second stages 28, 30 at twice the predetermined frequency.

The first exclusive OR gate 32 is connected to the outputs of the first and second stages 22, 24 of the first shift register 20 to provide a first binary indication signal on line 50 that indicates whether the delayed composite signal on line 40 periodically rises above the first biased signal on line 42 at the predetermined frequency. Referring to FIG. 2, the first binary indication signal on line 50 is a binary "1" only when the delayed composite signal on line 40 periodically rises above the first biased signal on line 42 at the predetermined frequency.

The second exclusive OR gate 34 is connected to the outputs of the first and second stages 28, 30 of the second shift register 26 to provide a second binary indication signal on line 52 that indicates whether the delayed composite signal on line 40 periodically falls below the second biased signal on line 44 at the predetermined frequency. Referring again to FIG. 2, the second binary indication signal on line 52 is a binary "1" only when the delayed composite signal on line 42 periodically falls below the second biased signal on line 44 at the predetermined frequency.

The AND gate 36 has its inputs connected to lines 50 and 52 from the respective outputs of the exclusive OR gates 32 and 34 and provides the flag signal on line 54. The flag signal is a binary signal. Referring to FIG. 2, the binary flag signal on line 54 is a binary "1" only when the first and second binary indication signals on lines 50 and 52 are also a binary "1". Thus, a binary "1" flag signal is provided on line 54 only when the delayed composite signal on line 40 both periodically rises above the first biased signal on line 42 at the predetermined frequency and periodically falls below the second biased signal on line 44 at the predetermined frequency.

Figure 3:
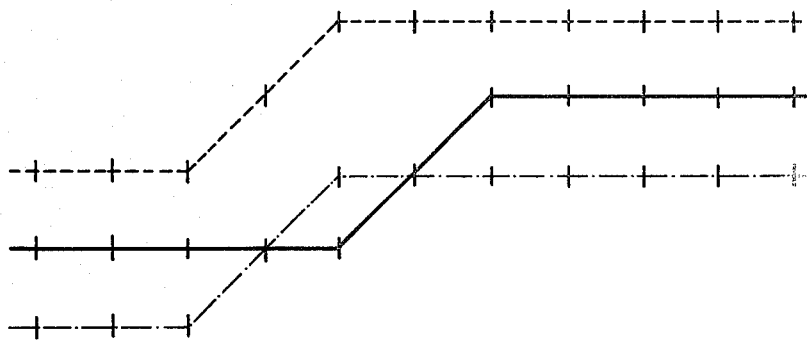
FIG. 3 illustrates signal conditions within the system in response to a sharp signal transition in the sampled composite signal other than an identification signal.

Referring to FIG. 3, it is seen that false signal recognition of a sharp transition in the sampled composite signal is avoided by the system of the present invention. A sharp rise in the sampled composite signal on line 38 causes the delayed signal on line 40 to temporarily fall below the biased signal on line 44. While the delayed signal on line 40 is below the biased signal on line 44 a binary "1" comparison signal is provided on line 48 from the second comparator 16. Also in response to the beginning of the signal transition on line 38, the second binary indication signal on line 52 changes from a binary "0" to a binary "1". However, the duration of the transition was longer than one-half the cycle of the identification signal; and as a result, the next second binary indication signal on line 52 immediately returned to a binary "0". The second binary indication signal also necessarily changes to a binary "1" for one clock period at the end of the transition in the sampled composite signal on line 38. The second binary indication signal on line 52 will remain a binary 1 over a sustained duration of several clock periods only if the delayed signal on line 40 periodically falls below the second biased signal on line 44 at the predetermined frequency.

However, in order for a binary "1" flag signal to be produced on line 54, the delayed signal on line 40 must also rise above the first biased signal on line 42 at the predetermined frequency. It is seen in the example of FIG. 3, that a positive transition in the sampled composite signal on line 38 never results in the delayed signal on line 40 rising above the first biased signal on line 42. As a result, the first comparison signal on line 46 and the first binary indication signal on line 50 both remain at binary "0"; and a binary "1" flag signal is not produced on line 54.

I claim:

1. A system for detecting the presence in a composite signal of an identification signal having a predetermined frequency, comprising delay means for delaying the composite signal by one-half the cycle of the identification signal as defined by the predetermined frequency to thereby provide a delayed signal;

means for biasing the composite signal to provide a first biased signal that is biased a predetermined differential above the composite signal, and to provide a second biased signal that is biased the predetermined differential below the composite signal;

a first comparator for comparing the first biased signal to the delayed signal to provide a first comparison signal that indicates when the delayed signal is above the first biased signal;

a second comparator for comparing the second biased signal to the delayed signal to provide a second comparison signal that indicates when the delayed signal is below the second biased signal; and a signal processor for processing the first and second comparison signals to provide a flag signal that indicates when the delayed composite signal both periodically rises above the first biased signal at the predetermined frequency and periodically falls below the second biased signal at the predetermined frequency, to thereby indicate detection of the identification signal.

2. A system according to claim 1, wherein the first comparator is adapted for providing as the first comparison signal, a binary signal that changes state in accordance with whether the delayed signal is above the first biased signal;

wherein the second comparator is adapted for providing as the second comparison signal, a binary signal that changes state in accordance with whether the delayed signal is below the second biased signal; and wherein the signal processor includes a first two-stage shift register for shifting the first comparison signal through its first and second stages at twice the predetermined frequency;

a second two-stage shift register for shifting the second comparison signal through its first and second stages at twice the predetermined frequency;

a first exclusive OR gate connected to the outputs of the first and second stages of the first shift register to provide a first binary indication signal that indicates whether the delayed composite signal periodically rises above the first biased signal at the predetermined frequency;

a second exclusive OR gate connected to the outputs of the first and second stages of the second shift register to provide a second binary indication signal that indicates whether the delayed composite signal periodically falls below the second biased signal at the predetermined frequency; and logic means connected to the outputs of the first and second exclusive OR gates for providing said flag signal.

3. A system according to claims 1 or 2, wherein the delay means consists of an analog delay line.

* * * * *